US007431974B2

(12) United States Patent
Lovelady et al.

(10) Patent No.: US 7,431,974 B2
(45) Date of Patent: Oct. 7, 2008

(54) TUFTED FABRIC WITH EMBEDDED STITCHES

(75) Inventors: Brian Lovelady, Soddy Daisy, TN (US); Steven Frost, Signal Mountain, TN (US); Ernest S Boyd, Ooltewah, TN (US)

(73) Assignee: Tuftco Corporation, Chattanooga, TN (US)

( * ) Notice: Subject to any disclaimer, the term of this patent is extended or adjusted under 35 U.S.C. 154(b) by 640 days.

(21) Appl. No.: 11/036,900

(22) Filed: Jan. 15, 2005

(65) Prior Publication Data

US 2005/0160955 A1 Jul. 28, 2005

(51) Int. Cl.

| | |
|---|---|
| ***B32B 3/02*** | (2006.01) |
| ***B32B 33/00*** | (2006.01) |
| ***B32B 5/26*** | (2006.01) |
| ***D05C 15/04*** | (2006.01) |

(52) U.S. Cl. ..... 428/89; 428/88; 112/80.01; 112/80.07; 112/475.23

(58) Field of Classification Search ..... 428/88, 428/89; 112/80.01, 80.7, 475.23
See application file for complete search history.

(56) References Cited

U.S. PATENT DOCUMENTS

| | | | | | |
|---|---|---|---|---|---|
| 2,862,465 | A * | 12/1958 | Card | 112/80.24 |
| 2,983,028 | A * | 5/1961 | Morrison | 428/85 |
| 3,084,645 | A * | 4/1963 | Card | 112/80.51 |
| 3,103,187 | A * | 9/1963 | Hammel, Jr. | 112/80.24 |
| 4,241,675 | A * | 12/1980 | Bardsley | 112/80.51 |
| 4,366,761 | A * | 1/1983 | Card | 112/80.41 |
| 4,659,602 | A * | 4/1987 | Birch | 428/88 |
| 4,671,194 | A * | 6/1987 | Frost et al. | 112/80.55 |
| 4,829,917 | A * | 5/1989 | Morgante et al. | 112/80.41 |
| 5,005,498 | A * | 4/1991 | Taylor et al. | 112/80.32 |
| 5,189,966 | A * | 3/1993 | Satterfield | 112/80.53 |
| 5,392,723 | A * | 2/1995 | Kaju | 112/80.23 |
| 5,544,605 | A * | 8/1996 | Frost | 112/475.23 |
| 5,549,064 | A * | 8/1996 | Padgett, III | 112/410 |
| 5,560,307 | A * | 10/1996 | Padgett et al. | 112/410 |
| 5,566,629 | A * | 10/1996 | Satterfield | 112/80.01 |
| 5,575,228 | A * | 11/1996 | Padgett et al. | 112/80.41 |
| 5,605,107 | A * | 2/1997 | Padgett et al. | 112/475.23 |
| 5,983,815 | A * | 11/1999 | Card | 112/80.73 |
| 6,009,818 | A * | 1/2000 | Card et al. | 112/80.73 |
| 6,014,937 | A * | 1/2000 | Lovelady | 112/80.41 |
| 6,279,497 | B1 * | 8/2001 | Lovelady | 112/80.54 |
| 6,283,052 | B1 * | 9/2001 | Pratt | 112/80.41 |
| 6,502,521 | B2 * | 1/2003 | Morgante et al. | 112/80.23 |
| 6,508,185 | B1 * | 1/2003 | Morgante et al. | 112/475.23 |
| 6,516,734 | B1 * | 2/2003 | Morgante et al. | 112/80.73 |
| 6,550,407 | B1 * | 4/2003 | Frost et al. | 112/475.23 |
| 6,740,386 | B2 * | 5/2004 | Hutchison | 428/88 |
| 6,745,184 | B1 * | 6/2004 | Choi et al. | 707/6 |
| 6,877,447 | B2 * | 4/2005 | Frost et al. | 112/80.73 |
| 6,905,751 | B2 * | 6/2005 | Jauregui | 428/89 |
| 7,033,661 | B2 * | 4/2006 | Whitten et al. | 428/88 |
| 7,216,598 | B1 * | 5/2007 | Christman, Jr. | 112/475.23 |
| 2003/0164130 | A1 * | 9/2003 | Morgante et al. | 112/475.23 |
| 2005/0160955 | A1 * | 7/2005 | Lovelady et al. | 112/80.73 |
| 2005/0193936 | A1 * | 9/2005 | Morgante et al. | 112/80.73 |
| 2006/0070564 | A1 * | 4/2006 | Smith et al. | 112/80.3 |

* cited by examiner

*Primary Examiner*—Cheryl Juska
(74) *Attorney, Agent, or Firm*—Douglas T. Johnson

(57) ABSTRACT

The present invention provides for tufted needlefelts with partially or totally obscured loop bights that provide good tuft bind.

8 Claims, 7 Drawing Sheets

TUFTED FABRIC WITH EMBEDDED STITCHES

FIELD OF THE INVENTION

This invention relates to tufting on a relatively thick substrate and selectively embedding some stitches in the substrate so that those stitches are either not visible or are only barely visible on the face of the carpet. Tufting in this fashion leaves the back stitching with a normal appearance and provides good tuft bind for each stitch. Needlefelt or needle punched fabrics are a preferred substrate.

BACKGROUND OF THE INVENTION

Needle punched material is typically manufactured by passing nonwoven substrate under a needle board which is reciprocated to cause repeated penetrations by the needles resulting in needle punched material, or needlefelt. Needle punched nonwovens have found widespread use in automotive, filtration, padding, as well as technical, medical and paper making felt applications. Another application for needlefelt has been as a form of inexpensive carpet. Repeated efforts have been made to enhance the appearance of needlefelts, through embossing, ribbing or creating relief-like structures, so that the appearance would be suitable for additional markets. The present invention involves utilizing needlefelt as substrate for tufting, and the creation of novel stitch appearance which is made possible due to the thickness of the needlefelt materials.

SUMMARY OF THE INVENTION

It is therefore an object of this invention to provide a method of enhancing the appearance of needlefelt without greatly increasing the cost of goods.

It is a further object of this invention to utilize precision yarn feed devices to selectively embed stitches in a relatively thick substrate so that those stitches are barely visible on the face of the resulting fabric.

It is another object of this invention to utilize precision yarn feed devices to selectively embed stitches in a relatively thick substrate so that those stitches are not visible on the face of the resulting fabric.

BRIEF DESCRIPTION OF THE DRAWINGS

The invention may be better understood with reference to the following drawings illustrating selected embodiments of the invention.

DETAILED DESCRIPTION OF THE INVENTION

Figures 1A, 1B:
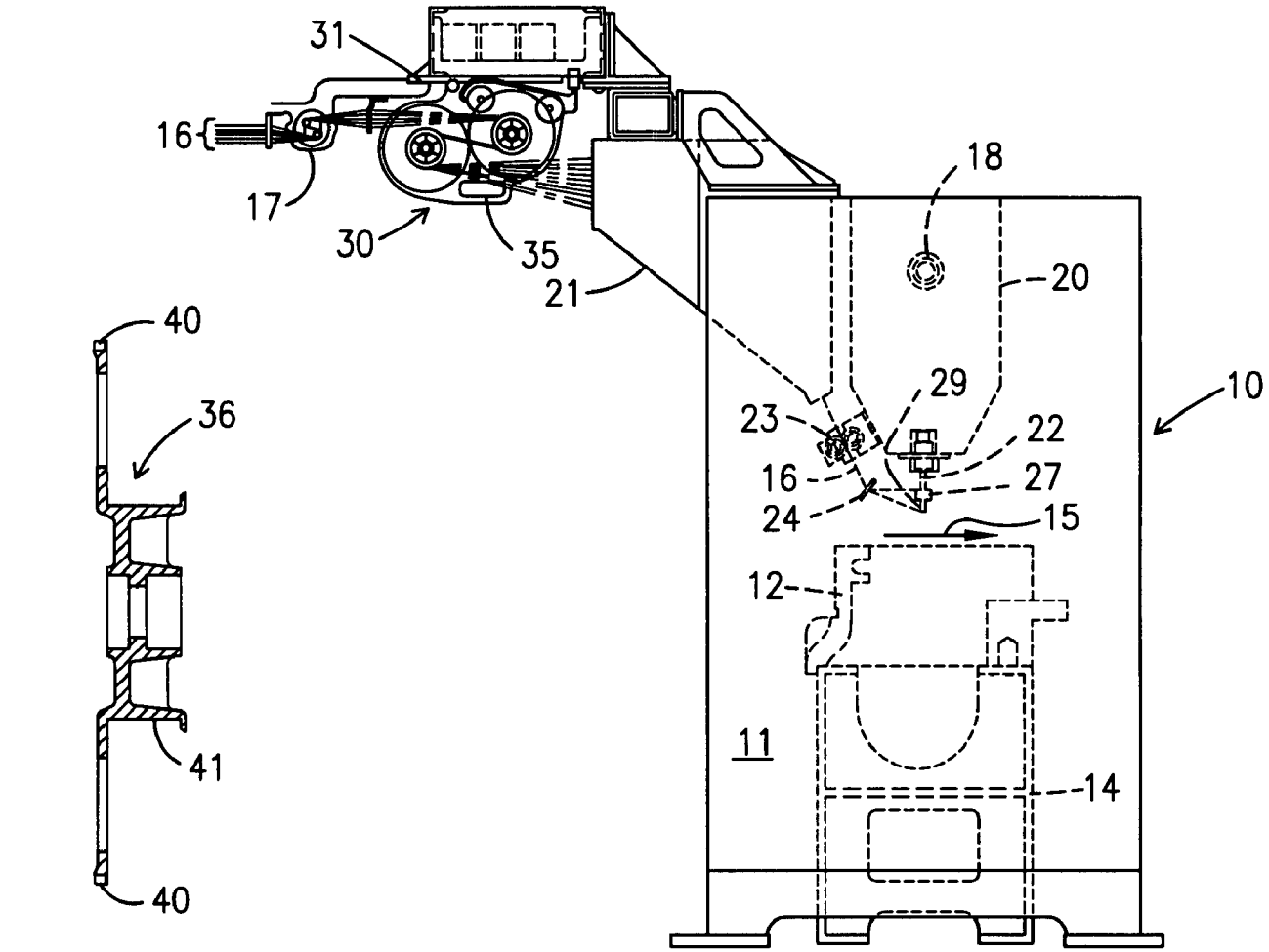
FIG. 1A is a side elevation view of a multiple needle tufting machine incorporating a precision control yarn feed mechanism useful in practicing the invention.
FIG. 1B is a sectional view of a yarn feed roll used in the mechanism of FIG. 1A.

Referring to the drawings in more detail, FIG. 1A discloses a multiple needle tufting machine 10 upon which is mounted a precision pattern control yarn feed attachment 30 as described in commonly owned U.S. Pat. No. 6,516,734 which is incorporated herein by reference. It is possible to mount attachments 30 on both sides of a tufting machine 10 when desired. The machine 10 includes a housing 11 and a bed frame 12 upon which is mounted a needle plate for supporting a base fabric adapted to be moved through the machine 10 from front to rear in the direction of the arrow 15 by front and rear fabric rollers. The bed frame 12 is in turn mounted on the base 14 of the tufting machine 10.

A main drive motor, not shown, drives a rotary main drive shaft 18 mounted in the head 20 of the tufting machine. Drive shaft 18 in turn causes push rods 22 to move reciprocally toward and away from the base fabric, which according to the invention is a needlefelt or other thick substrate. This causes needle bar 27 to move in a similar fashion. Needle bar 27 supports a plurality of preferably uniformly spaced needles 29 aligned transversely to the fabric feed direction 15. The needle bar 27 may be shiftable by means of well known pattern control mechanisms, not shown, such as Morgante, U.S. Pat. No. 4,829,917, or R. T. Card, U.S. Pat. No. 4,366,761. It is also possible to utilize two needle bars in the tufting machine, or to utilize a single needle bar with two, preferably staggered, rows of needles.

In operation, yarns 16 are fed through tension bars 17, pattern control yarn feed device 30, and tube bank 21. Then yarns 16 are guided in a conventional manner through yarn puller rollers 23, and yarn guides 24 to needles 29. A looper mechanism, not shown, in the base 14 of the machine 10 acts in synchronized cooperation with the needles 29 to seize loops of yarn 16 and form cut or loop pile tufts, or both, on the bottom surface of the base fabric in well known fashions.

In order to form a variety of yarn pile heights, a pattern controlled yarn feed mechanism 30 incorporating a plurality of pairs of yarn feed rolls adapted to be independently driven at different speeds has been designed for attachment to the machine housing 11 and tube bank 21.

As best disclosed in FIG. 1A, a transverse support plate 31 extends across a substantial length of the front of tufting machine 10 and provides opposed upwards and downwards facing surfaces. On the upwards facing surface are placed the electrical cables and sockets to connect with servo motors 38. On the downwards facing surface are mounted a plurality of yarn feed roller mounting plates 35. Mounting plates 35 have connectors to permit the plates 35 to be removably secured to the support plate 31 of the yarn feed attachment. Mounted on each side of each mounting plate 35 are a front yarn feed roll 36, a rear yarn feed roll 37 and a servo motor 38.

Each yarn feed roll 36, 37 consists of a relatively thin gear toothed outer section 40 which on rear yarn feed roll meshes with the drive sprocket of servo motor 38. In addition, the gear toothed outer sections 40 of both front and rear yarn feed rolls 36, 37 intermesh so that each pair of yarn feed rolls 36, 37 are always driven at the same speed. Yarn feed rolls 36, 37 have a yarn feeding surface 41 formed of sand paper-like or other high friction material upon which the yarns 16 are threaded, and a raised flange 42 to prevent yarns 16 from sliding off of the rolls 36, 37. Preferably yarns 16 coming from yarn guides 17 are wrapped around the yarn feeding surface 41 of rear yarn roll 37, thence around yarn feeding surface 41 of front yarn roll 36, and thence into tube bank 21.

Figure 2:
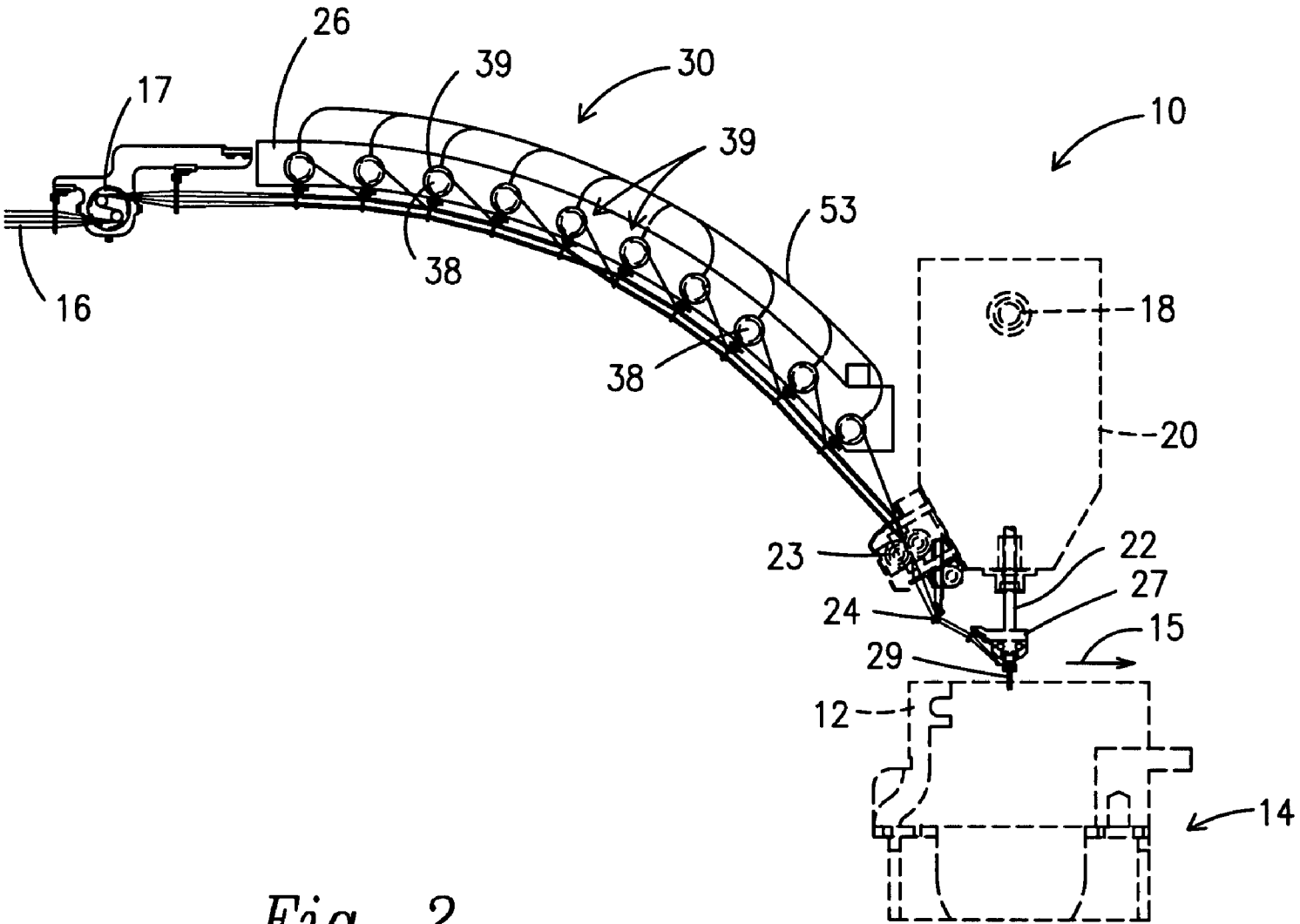
FIG. 2 is a side elevation view of an alternative embodiment of a precision control yarn feed mechanism useful in practicing the invention.

FIG. 2 discloses a multiple needle tufting machine 10 upon the front of which is mounted an alternative precision pattern control yarn feed attachment 30 useful practicing the invention as more completely described in U.S. Pat. No. 6,508,185 which is incorporated herein by reference. As with the pattern attachment of FIG. 1, it is possible to mount pattern control yarn feed attachments 30 of FIG. 2 on both sides of a tufting machine 10 when desired. The machine 10 includes a bed frame 12 upon which is mounted a needle plate, not shown, for supporting a base fabric in the form of a thick substrate adapted to be moved through the machine 10 from front to rear in the direction of the arrow 15 by front and rear fabric rollers. The bed frame 12 is in turn mounted on the base 14 of the tufting machine 10.

A main drive motor, not shown, drives a rotary main drive shaft 18 mounted in the head 20 of the tufting machine. Drive shaft 18 in turn causes push rods 22 to move reciprocally toward and away from the thick substrate. This causes needle bar 27 to move in a similar fashion. Needle bar 27 supports a plurality of preferably uniformly spaced needles 29 aligned transversely to the fabric feed direction 15. The needle bar 27 may be shiftable by means of well known pattern control mechanisms, not shown, such as Morgante, U.S. Pat. No. 4,829,917, or R. T. Card, U.S. Pat. No. 4,366,761. It is also possible to utilize two needle bars in the tufting machine, or to utilize a single needle bar with two, preferably staggered, rows of needles.

In operation, yarns 16 are fed through tension bars 17, into the pattern control yarn feed device 30. Then yarns 16 are guided in a conventional manner through yarn puller rollers 23, and yarn guides 24 to needles 29. A looper mechanism, not shown, in the base 14 of the machine 10 acts in synchronized cooperation with the needles 29 to seize loops of yarn 16 and form cut or loop pile tufts, or both, on the bottom surface of the substrate material in well known fashions.

As best disclosed in FIG. 2, a yarn drive array is assembled on an arching support bar 26 extending across the front of the tufting machine 10 and providing opposing vertical mounting surfaces on each of its sides. On the opposing side-facing surfaces are mounted a total of about 20 single end servo driven yarn feed drives 39, ten on each side.

In commercial operation, a typical broadloom tufting machine will utilize pattern controlled yarn feed devices 30 according to the present invention with 53 support bars 26, each bearing about twenty yarn feed drives 39 thereby providing 1060 independently controlled yarn feed rolls. The present feed attachment 30 provides substantially improved results by providing scroll type yarn control while eliminating the need for a tube bank and permits substantially exact lengths of selected yarns to be fed to the needles 29. Each yarn may be controlled individually to produce the smoothest possible finish. For instance, in a given stitch in a high/low pattern on a tufting machine that is not shifting its needle bar the following situations may exist:

1. Previous stitch was a low stitch, next stitch is a low stitch.
2. Previous stitch was a low stitch, next stitch is a high stitch.
3. Previous stitch was a high stitch, next stitch is a high stitch.
4. Previous stitch was a high stitch, next stitch is a low stitch.

Obviously, with needle bar shifting which requires extra yarn depending upon the length of the shift, or with more than two heights of stitches, many more possibilities may exist. In this limited example, it is preferable to feed the standard low stitch length in the first situation, to slightly overfeed for a high stitch in the second situation, to feed the standard high stitch length in the third situation, and to slightly underfeed the low stitch length in the fourth case. On a traditional yarn feed attachments, electromagnetic clutches can engage either a high speed shaft for a high stitch or a low speed shaft for a low stitch. Accordingly, the traditional type attachments cannot optimally feed yarn amounts for complex patterns which results in a less even finish to the resulting carpet. Many additional pattern capabilities are also present. For instance, by varying the stitch length only slightly from stitch to stitch, this novel attachment will permit the design and tufting of sculptured heights in pile of the carpet with stitches on the face of the carpet appearing to gradually emerge.

There are several advantages to having independently controlled single end yarn drives, particularly with regards to the patterns that can be created. By having each end of yarn independently controlled by its own dedicated yarn drive, this pattern device produces designs that are not possible using previous broad loom tufting machines. For instance, a non-continuous repeating pattern may be made across the width of the tufting machine, utilizing three or more yarn heights for each yarn. This pattern may consist of any design such as a word message or non-repeating geometric design across the entire carpet in various colors. Another design type that this type of pattern device may create is a rug with central design surrounded by a border. For example, a rug with a word phrase surrounded in the center by one color, then surrounded by a border of another color is easily be produced with this device without special consideration.

Most critical to the present invention is the capacity of the precision pattern control device to feed substantially exact lengths of yarns to the needles. This is best accomplished through the use of servo driven yarn feed devices such as those described above, or as may be used to drive the yarn feed rolls of Tuftco Corp.'s Rainbow Split Roll Attachment, or other patterning devices.

Figure 3A:
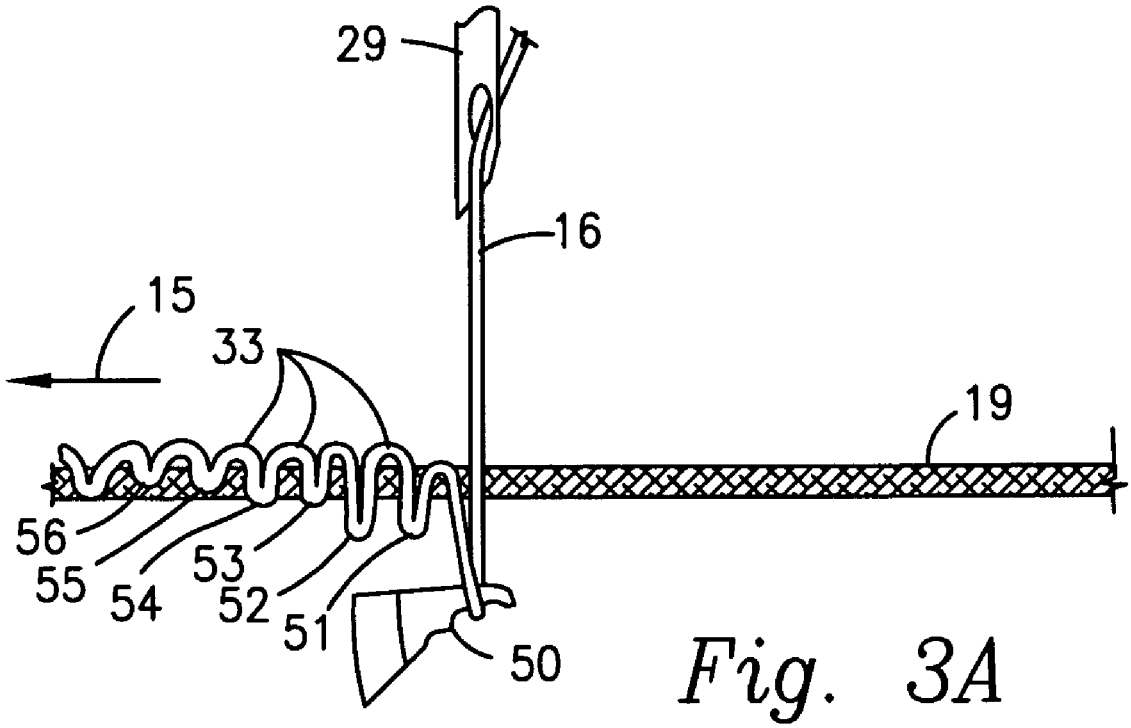
FIG. 3A is an enlarged view of the stitching action of a tufting machine creating regular stitches, barely visible stitches, and buried stitches in a thick substrate.

In FIG. 3A, the detail of tufting in a thick substrate such as needlefelt 19 is shown. Yarn 16 is supplied by reciprocating needle 29 and successively penetrates the needlefelt 19 as it moves in direction 15 through the tufting machine. When a relatively generous amount of yarn is supplied for a stitch, looper 50 seizes and releases the yarn 16 and there is relatively little backrobbing so that loop bights 51, 52 protrude from the backing material. When the yarn is supplied in a more restricted fashion for a stitch, the resulting loop bights 53, 54 may remain partially obscured by the needlefelt 19. When the yarn is supplied in the most restricted fashion, the resulting loop bights 55, 56 may remain embedded within the needlefelt. A regular backstitch 33 exists for each stitch. For the most precise control, yarn feeds are adjusted based upon not only the height of the stitch being fed, but also based upon the preceding stitch, or even two preceding stitches.

It will also be appreciated that in this form of tufting, the amount of yarn fed to form a subsequent stitch may affect the height of the preceding loop bight. Thus with reference to FIG. 3, needle 29 would have penetrated through the back surface of needlefelt 19 carrying yarn 16 to be seized by looper 50 on the front surface of the needlefelt 19 to form yarn bight 56 extending from the surface. On the next tufting cycle, needle 29 again penetrated the needlefelt 19 carrying yarn 16 to be seized by looper 50, however, the yarn feed pattern device is instructed to significantly underfeed the amount of yarn required to form yarn bight 55 on the surface of the needlefelt 19. This results in yarn being backrobbed from yarn bight 56 so that bight 56 no longer extends from the front surface of the needlefelt, or even reaches the front surface but is instead buried within the thickness of the fabric 19. Significantly underfeeding the yarn on the tufting cycle forming bight 54 on the surface of the needlefelt 19 results in burying bight 55 as illustrated in FIG. 3. The amounts of yarn fed in the tufting cycles forming yarn bights 53, 52 is somewhat greater, being only slightly underfed, so that the preceding bights 54, 53 are backrobbed only until the height of the bights 54, 53 extend to about the same height as the front surface of the needlefelt 19. When yarn 16 is adequately fed for the tufting cycle forming yarn bight 51, the yarn in previously formed yarn bight 52 is not significantly backrobbed and bight 52 remains protruding above the front surface of fabric 19.

Figure 3B:
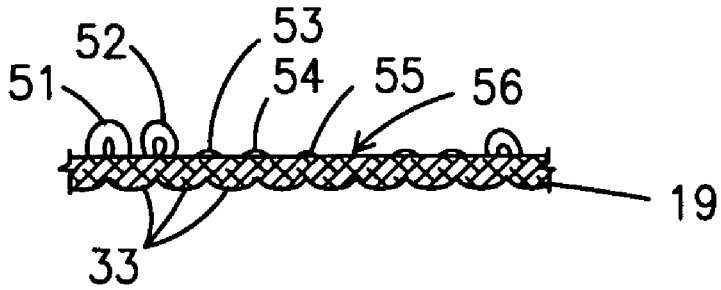
FIG. 3B is a sectional view of the resulting greige after tufting a thick substrate with regular stitches, barely visible stitches, and buried stitches.
Figure 4:
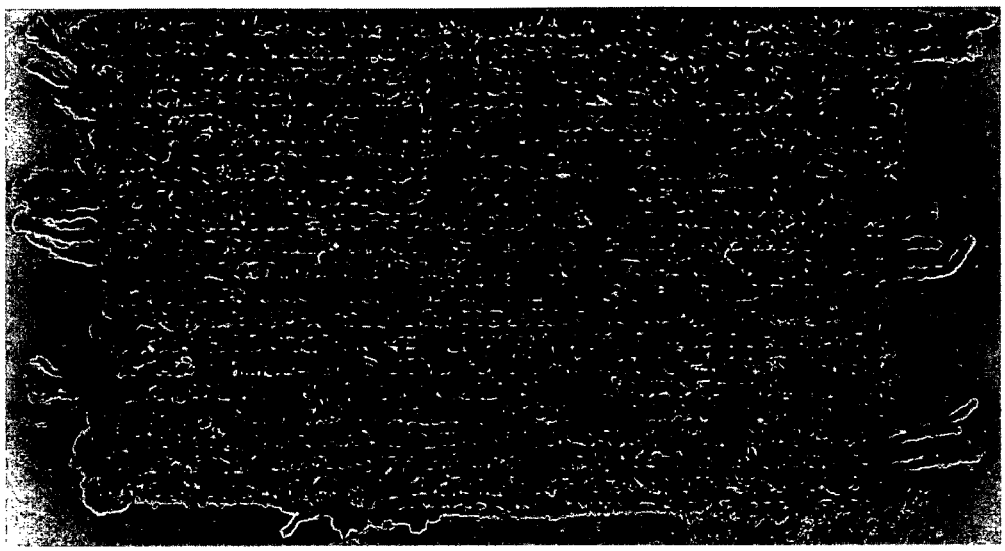
FIG. 4 is the back of a tufted substrate showing regular back stitching in substrates tufted according to the present invention.
Figure 5A:
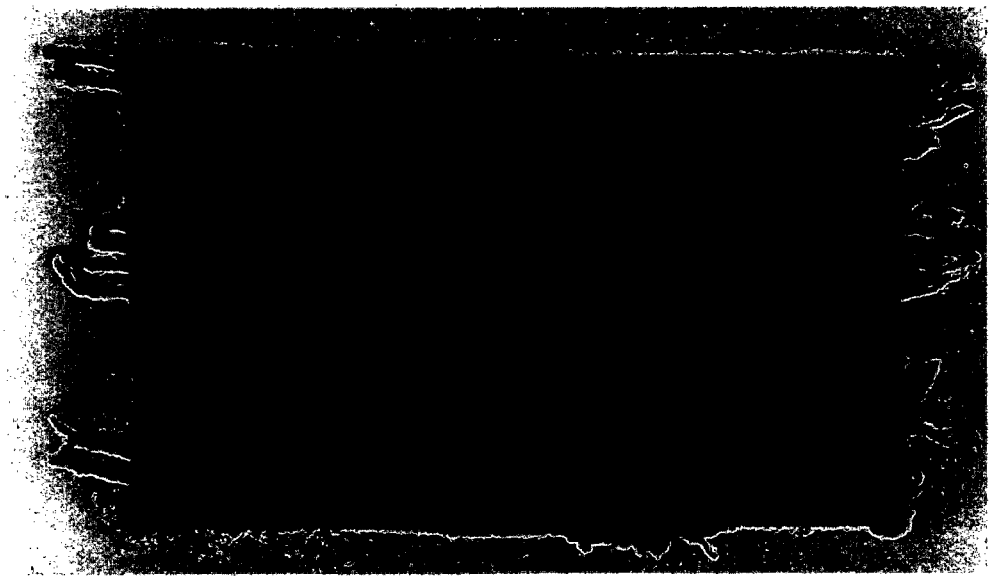
FIG. 5A through 5D are illustrations of the face of substrates tufted according to the present invention with regular stitches, barely visible stitches, and buried stitches.
Figure 5B:
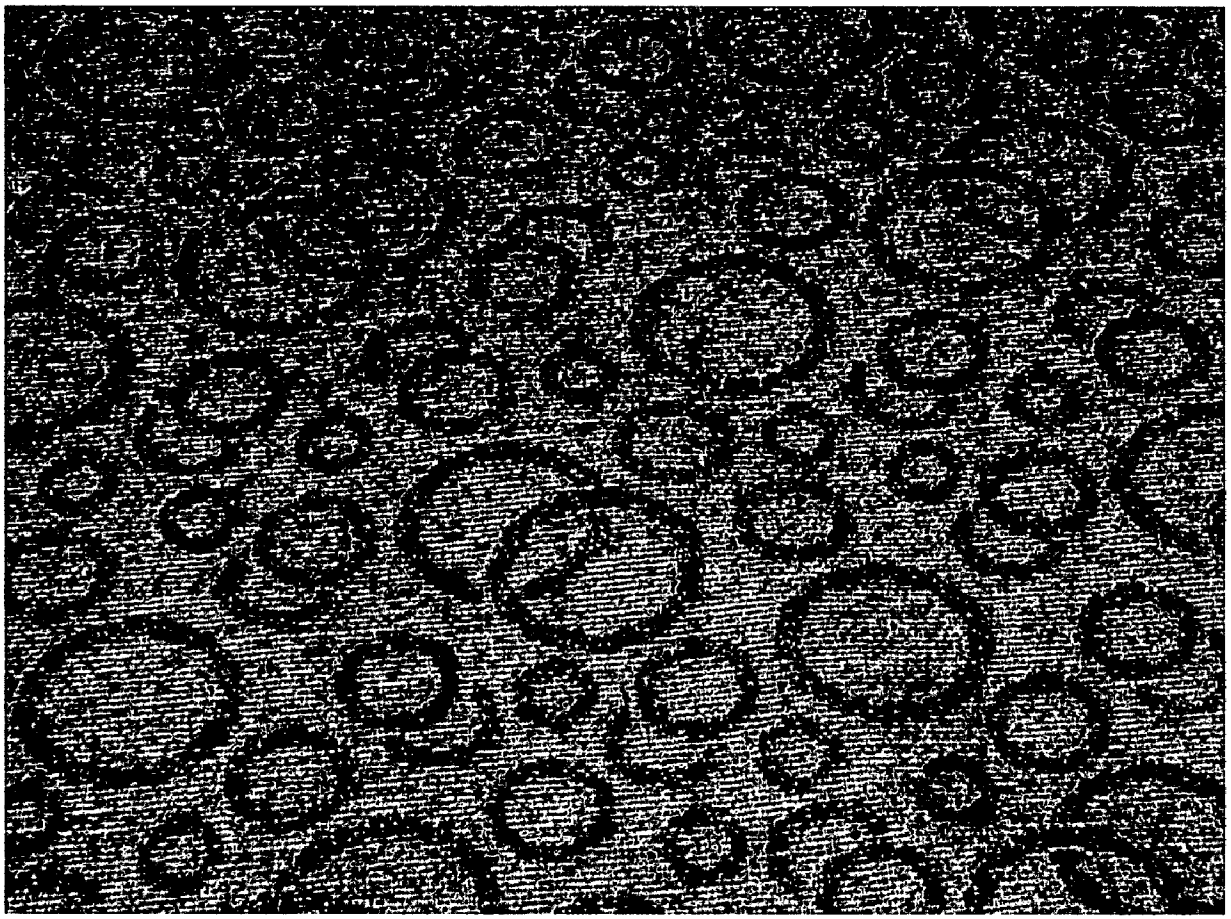
Figure 5C:
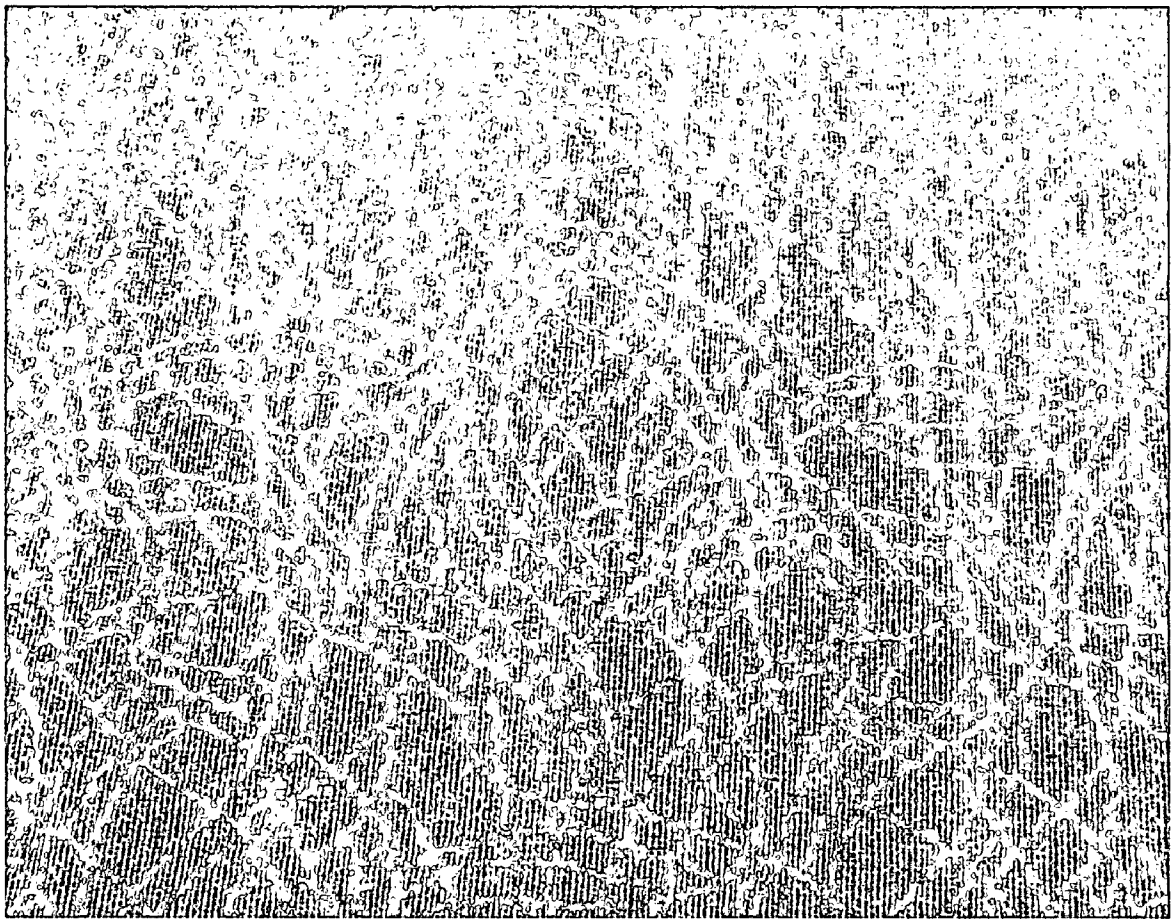
Figure 5D:
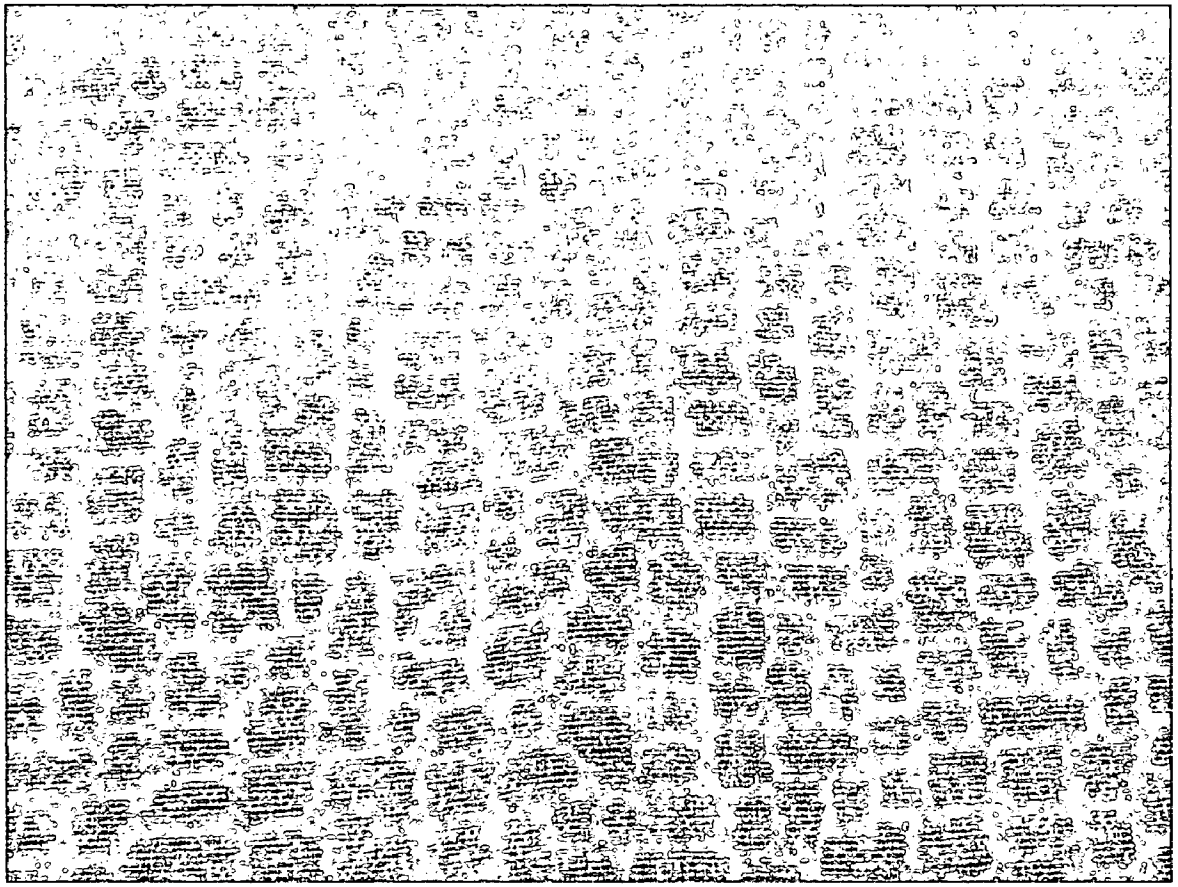

In prior art tufting, when it has been desired to completely hide the appearance of a stitch, the loop formed has been completely pulled out of the backing material, providing no tuft bind at that location. It has also not been possible to produce loop bights that were partially obscured by the backing material. FIG. 3B provides an illustration, and FIGS. 4 and 5A-D provide photographic depictions of tufted needlefelt according to the invention. FIG. 4 shows the regular backstitch, with each stitch being anchored so that there is substantially uniform tuft bind when the latex or other binder is applied to the back surface. FIGS. 5A-D show patterns with regular visible loop bights, as well as other bights that are partially and totally obscured by the needlefelt backing.

For the most cost effective patterning, tufted yarns are applied at a weight of only about 12-17 ounces of yarn per square yard. However, weights of between about 5 and 30 ounces per square yard may be suitable for some purposes. The needlefelts suitable for use as a thick substrate are typically polypropylene nonwovens with a thickness of about 1.5 to 2 millimeters. Thicknesses from about 1 to about 7 millimeters are suitable for some purposes, but it is difficult to totally obscure stitches in the narrower range of needlefelts.

The resulting tufted needlefelts are desirable for inexpensive floor coverings after being treated with latex, polyurethane or other suitable binders, and preferably attached to a secondary backing.

While preferred embodiments of the invention have been described above, it is to be understood that any and all equivalent realizations of the present invention are included within the scope and spirit thereof. Thus, the embodiments depicted are presented by way of example only and are not intended as limitations upon the present invention. While particular embodiments of the invention have been described and shown, it will be understood by those skilled in the art that the present invention is not limited thereto since many modifications can be made. Therefore, it is contemplated that any and all such embodiments are included in the present invention as may fall within the scope of the appended claims.

We claim:

1. A tufted fabric having a face and an opposite back surface defining a thickness there between wherein a first group of tufted bights of yarn extend from the face;

a second group of tufted bights of yarn extend through the thickness of the fabric to about the face; and a third group of tufted bights extend into the thickness of the fabric but do not extend to the face such that the back surface has back stitches for stitches forming the first, second and third groups of tufted bights of yarn.

2. The tufted fabric of claim 1 wherein the fabric is a needlefelt.

3. The tufted fabric of claim 1 wherein the thickness is between 1 and 7 millimeters.

4. The tufted fabric of claim 3 wherein the thickness is between 1.5 and 2 millimeters.

5. The tufted fabric of claim 1 wherein the weight of the yarns forming first, second and third groups of bights and associated backstitches is between 5 and 30 ounces per square yard.

6. The tufted fabric of claim 5 wherein the weight of the yarns forming first, second and third groups of bights and associated backstitches is between 12 and 17 ounces per square yard.

7. The tufted fabric of claim 1 wherein a binder is applied to the back surface and cured such that the resulting tufted fabric has substantially uniform tuft bind.

8. The tufted fabric of claim 7 wherein the binder is selected from the group of latex and polyurethane.

* * * * *